US008146676B2

(12) United States Patent
Zhang et al.

(10) Patent No.: US 8,146,676 B2
(45) Date of Patent: Apr. 3, 2012

(54) MULTIFUNCTIONAL POWER TOOL

(75) Inventors: Shisong Zhang, Jiangsu (CN); Hongfeng Zhong, Jiangsu (CN)

(73) Assignee: Positec Power Tools (Suzhou) Co., Ltd., Suzhou, Jiangsu (CN)

( * ) Notice: Subject to any disclaimer, the term of this patent is extended or adjusted under 35 U.S.C. 154(b) by 179 days.

(21) Appl. No.: 12/450,980

(22) PCT Filed: Mar. 31, 2008

(86) PCT No.: PCT/CN2008/000648

§ 371 (c)(1), (2), (4) Date: Apr. 2, 2010

(87) PCT Pub. No.: WO2008/128418

PCT Pub. Date: Oct. 30, 2008

(65) Prior Publication Data

US 2010/0186977 A1 Jul. 29, 2010

(30) Foreign Application Priority Data

Apr. 18, 2007 (CN) ..... 2007 1 0021300

(51) Int. Cl.
*B25D 15/02* (2006.01)

(52) U.S. Cl. ..... 173/48; 173/109; 173/178; 173/216

(58) Field of Classification Search ..... 173/47, 173/48, 176, 178, 205, 104, 109, 217, 216, 173/117

See application file for complete search history.

(56) References Cited

U.S. PATENT DOCUMENTS 5,343,961 A * 9/1994 Ichikawa ..... 173/48

(Continued)

FOREIGN PATENT DOCUMENTS

CN 2292902 Y 9/1998

(Continued)

OTHER PUBLICATIONS

English language abstract for CN 2292902 extracted from espacenet.com database, dated Apr. 23, 2010, 1 page.

(Continued)

*Primary Examiner* — Scott A. Smith

(74) *Attorney, Agent, or Firm* — Howard & Howard Attorneys PLLC

(57) ABSTRACT

The invention related to a multi-functional power tool, comprises an housing, a motor set in the housing, a main shaft driven through the rotation of the motor, a working shaft extended outside the housing, an active impact block, which can rotate with and make axial motion with respect to the main shaft, is configured on the main shaft, a passive impact block which rotates with the working shaft and can alternatively make axial motion with respect to the working shaft is mounted on the working shaft, the active impact block rotates to drive the passive impact block through the coordination of the first end tooth set on the active impact block and the second end tooth set on the passive impact block; the power tool further includes a function shifting button which can move between the first location and the second location to alternatively limit the passive impact block's axial motion with respect to the working shaft, in this way to realize the shifting between the first function and the second function of the power tool. This function shifting mechanism features simple structure, low manufacturing cost, convenient and efficient operation.

20 Claims, 6 Drawing Sheets

U.S. PATENT DOCUMENTS

| | | | | |
|---|---|---|---|---|
| 5,531,278 | A * | 7/1996 | Lin | 173/176 |
| 5,601,149 | A * | 2/1997 | Kawasaki et al. | 173/93.5 |
| 6,199,640 | B1 * | 3/2001 | Hecht | 173/48 |
| 6,688,406 | B1 * | 2/2004 | Wu et al. | 173/48 |
| 7,124,839 | B2 * | 10/2006 | Furuta et al. | 173/104 |
| 7,380,613 | B2 * | 6/2008 | Furuta | 173/48 |
| 7,410,007 | B2 * | 8/2008 | Chung et al. | 173/48 |
| 7,735,575 | B2 * | 6/2010 | Trautner | 173/114 |
| 7,798,245 | B2 * | 9/2010 | Trautner | 173/48 |
| 2005/0199404 | A1 | 9/2005 | Furuta et al. | |
| 2006/0213675 | A1 | 9/2006 | Whitmire et al. | |

FOREIGN PATENT DOCUMENTS

| | | | |
|---|---|---|---|
| CN | 1836847 | A | 9/2006 |
| EP | 1050381 | A2 | 11/2000 |

OTHER PUBLICATIONS

English language abstract for CN 1836847 extracted from espacenet.com database, dated Apr. 23, 2010, 1 page.

PCT International Search Report for PCT/CN2008/000648, dated Jul. 17, 2008, 3 pages.

* cited by examiner

MULTIFUNCTIONAL POWER TOOL

CROSS REFERENCE TO RELATED APPLICATION

This application claims priority to and all the advantages of International Application No. PCT/CN2008/000648, filed on Mar. 31, 2008, which claims priority to Chinese Patent Application No. 200710021300.8, filed on Apr. 18, 2007.

FIELD OF TECHNOLOGY

The present invention relates to a power tool, and more especially, to a multi-functional power tool capable of realizing impact wrench function and electric drill function or electric screwdriver set function or impact drill function.

BACKGROUND OF THE INVENTION

Among the existing power tools, the impact wrench is used to tighten the screw fastener to work piece. It generally comprises a main shaft driven by the rotation of the motor, impact block connected with the main shaft through spiral scroll and ball, and working shaft fit for the impact block through the end tooth and located in front of the impact block. An impact spring is configured in the back of the impact block, which compresses the impact block to enable the impact block to keep reliable coordination with the working shaft. During working, the rotation movement of the main shaft directly outputs to the screw piece through the impact block and working shaft so as to secure the screw piece to work piece. During the tightening, the load on the working shaft gradually increases. When the load exceeds the preset value, the impact moves toward the motor relative to the working shaft through the rolling of the ball in the spiral scroll, and compresses the spring behind it. At the moment that the impact block and the end tooth of the working shaft are unfitted, under the action of the impact spring, the impact block moves forward in axial direction and beats the working shaft in rotation direction, so as to enable the working shaft to keep tightening the screw piece in the direction of rotation. In such cycles, through endless intermittent beating of the impact block, the screw piece can be secured to a work piece in the end. Electric drill is used to drill holes in work piece. However, the user generally requires tightening screw pieces onto the work piece or drilling holes in work piece during working. In this way, it is very inconvenient when the user is required to change tools again and again for operation.

US patent application No. 2005/0199404A1 discloses a power tool capable of realizing impact wrench and electric drill functions in one tool. The power tool secures the impact block (7) and working shaft (8) on the outer circumference through function shifting mechanism (the function shifting button 33 and connecting piece 25 shown in FIG. 1 and FIG. 4 of this patent for application) to keep the impact and working shaft relatively fixed, in this way, to realize the shifting between impact wrench function and electric drill function. With this structure, the user is only required to adjust the function shifting button to shift between impact wrench function and electric drill function. European patent application No. EP 1050381 A2 discloses another power tool with both impact wrench function and electric drill function. The power tool secures the impact block (5) and working shaft (6) along the axis through function shifting mechanism (Drawing 15, 16, 24, 35 and 36 attached to the patent for application) to keep the impact and working shaft relatively fixed, in this way, to realize the shifting between impact wrench function and electric drill function. However, the power tool disclosed by the abovementioned US patent for application uses a round sleeve with relatively large size as the connecting piece, in this way to increase the overall volume of the power tool, improve manufacturing cost; while the function shifting mechanism of the power tool disclosed by the abovementioned European patent for application requires multiple components' cooperation, and the reliability is reduced due to the complicated structure.

SUMMARY OF THE INVENTION

The present invention provides a multi-functional power tool which can realize the shifting between impact wrench function and electric drill function or functions. This function shifting mechanism features simple structure, low manufacturing cost, convenient and efficient operation.

Aimed to realized the above features, the present invention provides: A multi-functional power tool, characterized in that: the power tool comprises an housing, a motor set in the housing, a main shaft driven through the rotation of the motor, a working shaft used to connect corresponding working head when running, wherein an active impact block, which can make axial motion with respect to the main shaft, is configured on the main shaft, a passive impact block which rotates with the working shaft and can alternatively make axial motion with respect to the working shaft is mounted on the working shaft, the active impact block rotates to drive the passive impact block through the coordination of the first end tooth set on the active impact block and the second end tooth set on the passive impact block; the power tool further includes a function shifting button which can move between the first location and the second location to alternatively limit the passive impact block's axial motion with respect to the working shaft, in this way to realize the shifting between the first function and the second function of the power tool.

As an improvement of the invention, the power tool further comprises a compression piece set on the passive impact block and away from the side of the active impact block, wherein the compression piece compresses the passive impact block so that the passive impact block is apt to make movement toward the active impact block.

Aimed to realized the above features, the present invention also could provides: A drilling tool, characterized in that: the power tool comprises an housing, a power source, a main shaft driven by the power source and a working shaft fit for the working head, the main shaft is provided with impact storage block making axial movement with respect to the main shaft, wherein the working shaft is provided with the passive impact block in axial movement, the first working mode and the second working mode exist between the impact storage block and passive impact block, wherein there is no relative axial displacement between the impact storage block and passive impact block in the first working mode, while there is relative axial displacement between the impact storage block and passive impact block in the first working mode, a function shifting button is set on the housing, which includes a location limiting part alternatively limiting the axial movement of the passive impact block.

Aimed to realized the above features, the present invention also could provides: A power tool, comprising:

An housing;

A power source, set in the housing and outputting rotation power;

A working shaft, extending toward the front of the housing and capable of connecting the external working head;

A gear reduction mechanism, set between the power source and working shaft and transmitting the rotation output of power source to the working shaft;

An active impact block, driven by the rotation of output shaft of the gear reduction mechanism;

A passive impact block, capable of engaging with the active impact block and driven by the rotation, the passive impact block is set on the working shaft and rotates to drive the working shaft, and the passive impact block can make axial motion with respect to the working shaft, wherein the active impact block can alternatively ungear the passive impact block when the load on the working shaft increases to the specific value, then mesh with the passive impact block again under the output shaft's rotation driving, thus to exert intermittent impact on the working shaft in the direction of rotation.

An impact shifting piece, capable of alternatively limiting the passive impact block's axial motion with respect to the working shaft, so as to make the impact mechanism shift between the impact status that the active and passive impact blocks can ungear each other and the limiting status that the active and passive impact blocks cannot ungear each other.

Compared with the existing technology, the present invention has the following favorable effects: the power tool is additionally provided with independent passive impact block, and limits the passive impact block's movement together with the active impact block through function shifting button, thus to realize impact wrench function; moreover, this function shifting button can also cancel the limitation to the passive impact block, so as to make it move together with the active impact block, thus to realize drilling function, wherein the abovementioned function shifting mechanism features simple structure, relatively low manufacturing cost, convenient and efficient operation.

BRIEF DESCRIPTION OF THE DRAWINGS

The present invention is further detailed in combination with the drawings attached and embodiments hereinafter, wherein.

Similar to FIG. 3.

DESCRIPTION OF PREFERRED EMBODIMENTS

Figure 1:
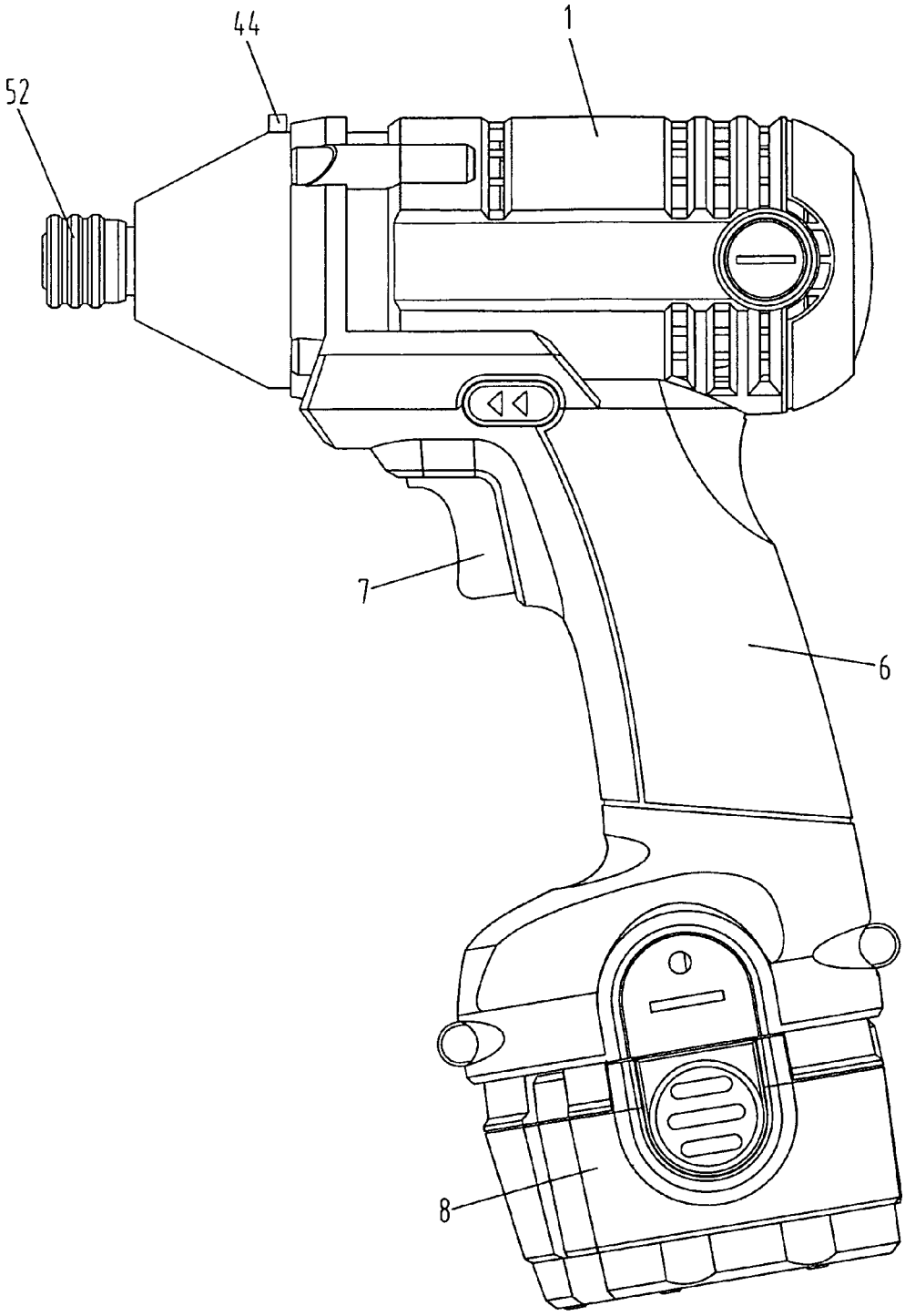
FIG. 1 is the front view of the multi-functional power tool in the embodiment for the present invention.

FIG. 1-7 show an embodiment of the multi-functional power tool for the present invention. In this embodiment, the power tool is provided with impact wrench function and drilling function. As shown in FIG. 1, the power tool 100 comprises an housing 1 distributed horizontally, a handle 6 arranged to form certain angle with the housing and the detachable battery pack 8 at the bottom of the handle. A tool gripper 52, set in the front of the housing 1, used to hold different working heads (no drawings) respectively for realizing different functions. If gripping fastener when realizing impact wrench function, hold twist drill while realizing drilling function. A switch 7 is mounted on the handle 6, through which the operator can start up the power tool through pressing this switch.

Figure 2:
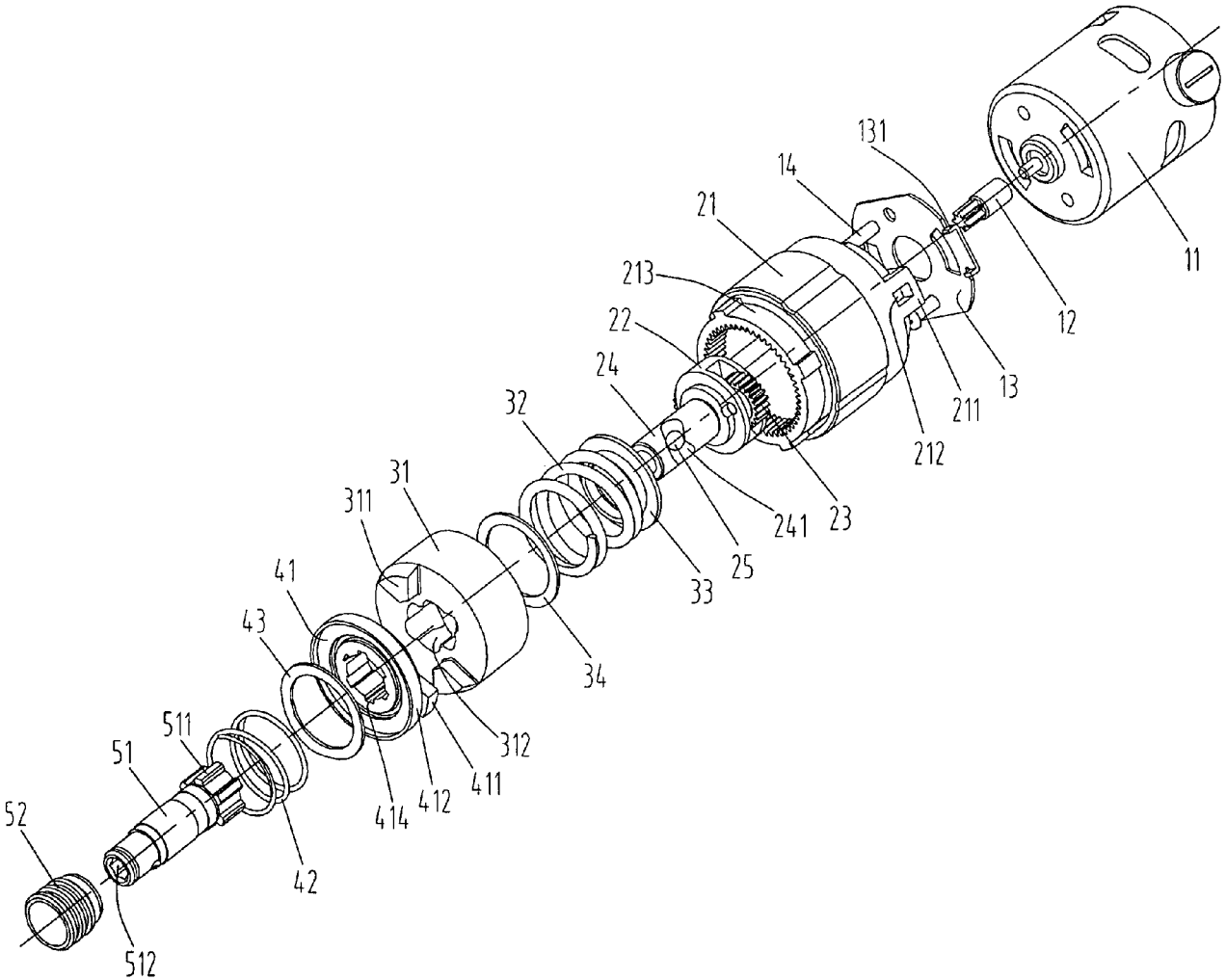
FIG. 2 is the exploded view of working parts of the multi-functional power tool shown in FIG. 1.

FIG. 2 shows the working parts of the power tool configured in the horizontal housing. As shown in FIG. 2, from right to left of the figure, working parts include a motor 11 and motor output shaft 12 extended from the front of the motor. A gear reduction system is set in front of the motor 11. In this embodiment, the reduction system is planetary gear reduction system which comprises gearbox 21 and planetary carrier 22. Internal gear 213 is set in front of the gearbox 21 and several planetary gears 23 are mounted on the planetary carrier 22. The motor output shaft 12 is in the center of several planetary gears 23 and is engaged with various planetary gears, while the periphery of the planetary gear 23 and internal gear 213 mesh. When the motor runs, the motor output shaft 12 drives the planetary gear 23 to run inside the internal gear 213, so as to transmit the rotation speed of motor output to the main shaft 24 linking the planetary carrier 22 through certain reduction ratio. A distribution board 13 is set between the motor and gear reduction system, and secured with the main body of the motor 11 through screw stud 14. A pair of clamping arms 131 extends forwards from the both sides of the distribution board 13 in a symmetrical way, which is firmly clamped on the lug 211 projecting from the back of the gearbox 21, wherein the inner recess in the outside of the lug 211 forms a notch 212 which can house the lug projecting from the internal wall of the housing 1 (not shown in the drawings). With this structure, the motor 11 and gear reduction system can be reliably secured inside the housing 1. In front of the gear reduction system sets a mechanism used to realize the impact wrench function, comprising a set of active impact block 31 on the main shaft 24, impact spring 32 between active impact block 31 and gearbox 21, and spiral scroll impact mechanism of internal ball located at the junction of active impact block 31 and main shaft 24, wherein the impact mechanism consists of outer spiral scroll 241 formed by the depression of the surface of main shaft 24, ball 25 capable of rolling in the outer spiral scroll 241. In this embodiment, the ball is steel and set in the inner ring of active impact 31 to house the internal spiral scroll 312 of the ball 25. A pair of the first end teeth 311 protrudes in the front of active impact block 31 in a radial and symmetrical way. Gaskets 33, 34 are set between impact spring 32 and gearbox 21, impact spring 32 and active impact block 31.

Figure 3:
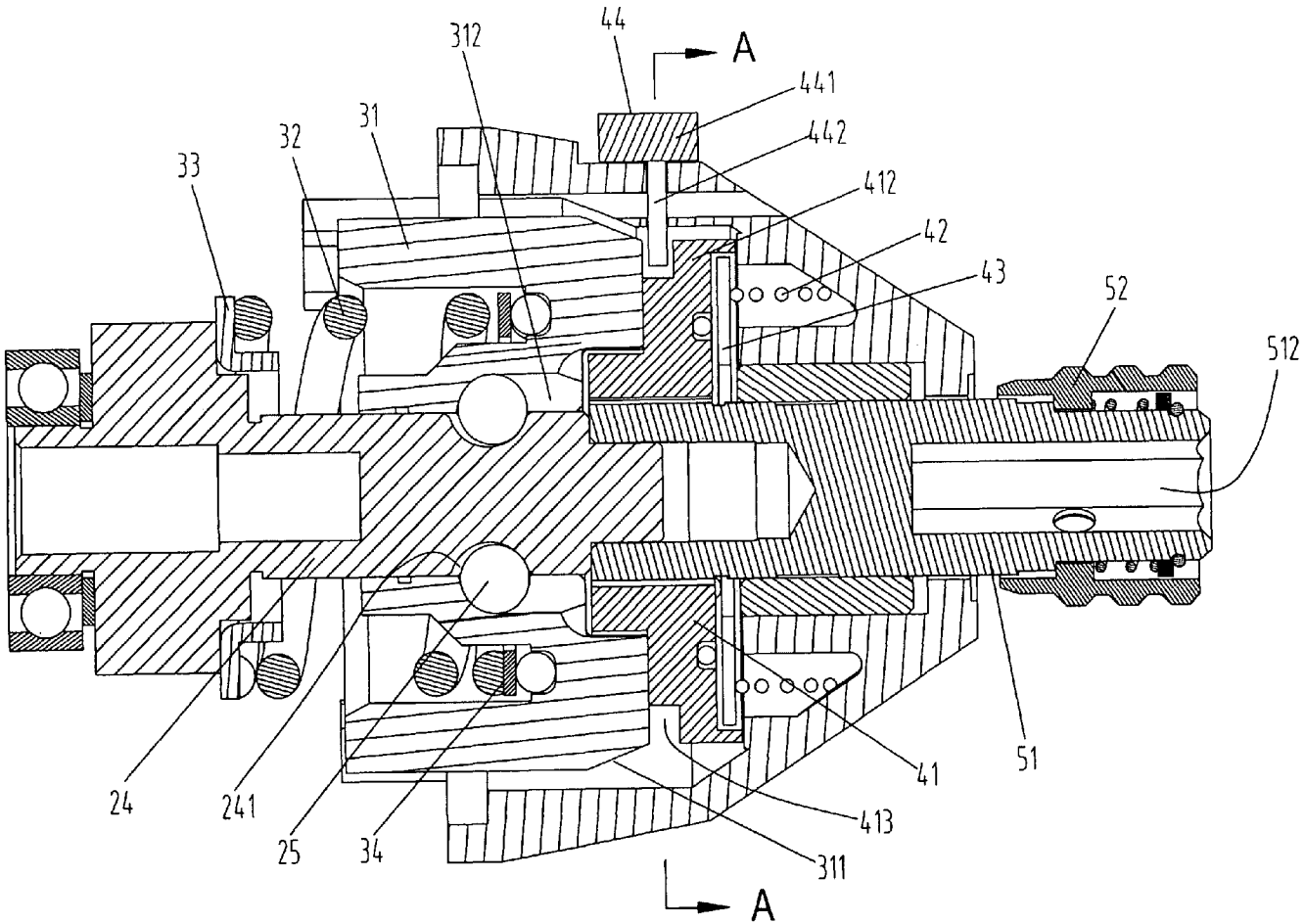
FIG. 3 is partial and sectional scheme of the multi-functional power tool shown in FIG. 1, mainly disclosing the realizing mechanism of impact wrench function and drilling function, and function shifting mechanism; wherein the power tool is in the low resisting moment status of the impact wrench function status; at this time, the function shifting button is at the first location, and the passive-active impact block is compressed by the sub-passive-active impact block to deviate from function shifting button location.

By referring to FIG. 3, the working parts further comprise function adjusting mechanism in front of the active impact block 31, working shaft 51 extending from the front of the housing 1, and tool gripper 52 set around the front of the housing 1. The function adjusting mechanism consists of passive impact block 41, function shifting button 44 and compression piece 42, wherein the function adjusting block 41 is set in the face of active impact block 31, the second end tooth 411 capable of being engaged with the first end tooth 311 of the active impact block 31 extends from the back in a radial and symmetrical way, a shoulder 412 forms in the front and is set between the shoulder 412 and the second end tooth 411 at certain interval. Several key slots 414 are arranged on the circumference of the inner ring of passive impact block 41, which can correspondingly house several raised keys 511 formed on working shaft 51. With this structure, the passive impact block 41 can run together with the working shaft 51, and the passive impact block 41 can make axial movement with respect to the working shaft 51. It is easy to figure out the solution for common technicians in this field that key slot and raised key can be interchanged, namely, key slot can be set on the working shaft and raised key can be set on passive impact block. In this embodiment, the compression piece 42 is a spiral spring, wherein the back props up the passive impact block through a gasket 43, and the front props up the inner wall of the housing 1. Certainly, the compression piece can be also composed of plate spring or other elastic elements. In front of the working shaft 51 sets housing slot 512 capable of housing corresponding working heads when realizing different functions and being clamped and secured firmly through the tool gripper 52.

Figure 6:
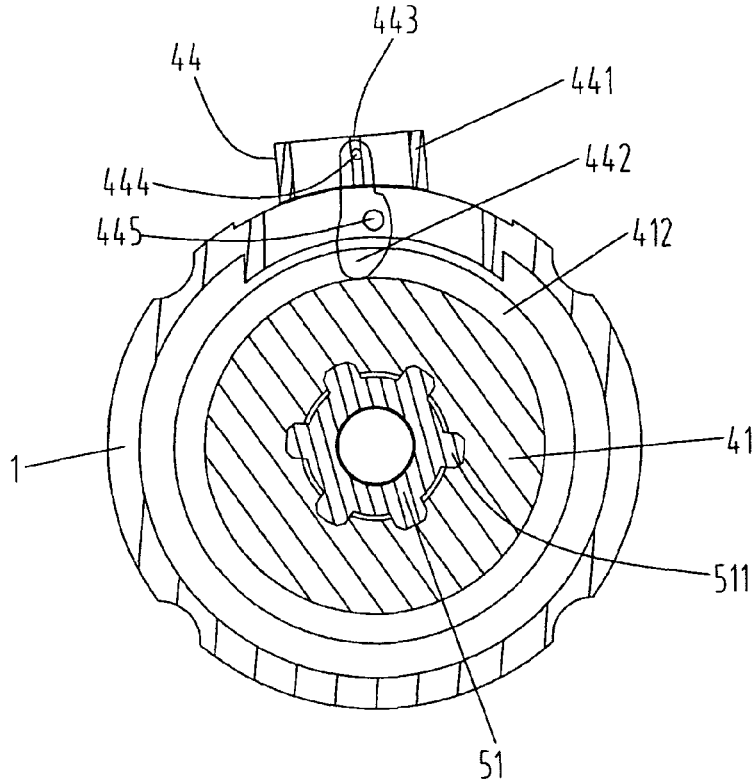
FIG. 6 is sectional scheme along A-A line direction in FIG. 4.
Figure 7:
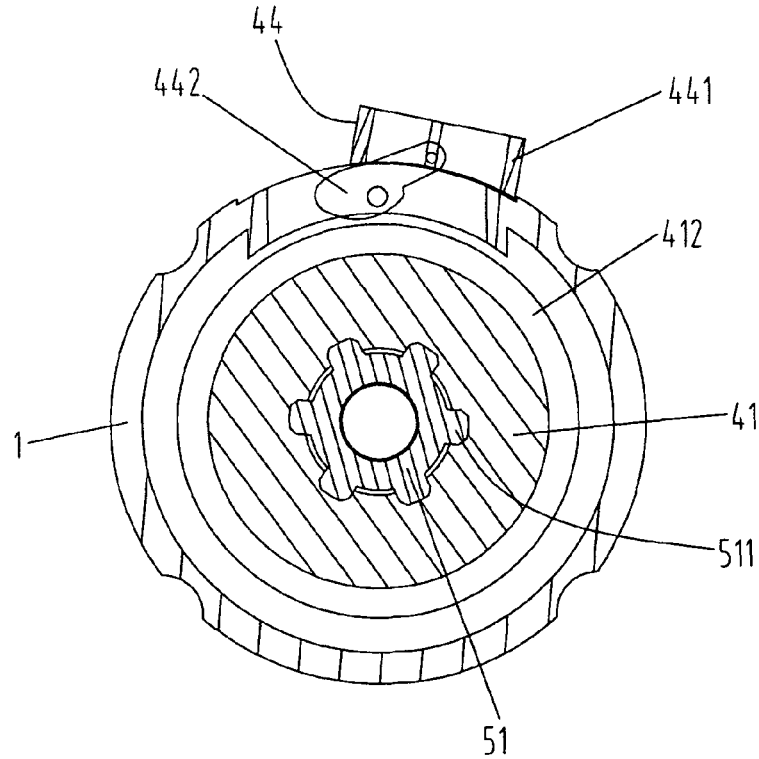
FIG. 7 is sectional scheme along B-B line direction in FIG. 6.

By referring to FIG. 6 and FIG. 7, in this embodiment, the function shifting button 44 comprises the operating part 441 outside the housing 1 and the location limiting part 442 capable of extending into the housing 1, wherein the operating part 441 is a sliding block and capable of sliding on the outer circumference of the housing 1. A slide way 443 is arranged on the operating part 441 along the vertical direction. The operating part 441 and location limiting part 442 are connected through a movable pivot 444 which (the movable pivot 444) can roll in the slide way 443 of the operating part 441. The upper part of the location limiting part 442 is connected with the movable pivot 444 to allow the pivot to rotate around the movable pivot. The location limiting part 442 can extend into the housing through the opening in the wall of the housing 1, and can be alternatively located in the spacing area 413 between the shoulder 412 of the passive impact block 41 and the second end tooth 411, and can be against the shoulder 412 at a specific location. The fixed pivot 445 is set in the opening area of the housing 1. The middle part of the location limiting part 442 is connected with the fixed pivot 445 to allow the pivot to rotate around the pivot. With this structure, the user is only required to glide the operating part 441 on the surface of the housing 1, in this way, the location limiting part 442 can alternatively enter into the spacing area 413 between the shoulder 412 of the passive impact block 41 and the second end tooth 411, or stay outside the spacing area 413, such as in the opening area of the housing. Certainly, it is easy to figure out the solution for common technicians in this field that the function shifting button is made into simple plug-in type element, namely, located in the spacing area after plugging through the housing opening, or outside the spacing area after unplugging.

Figure 4:
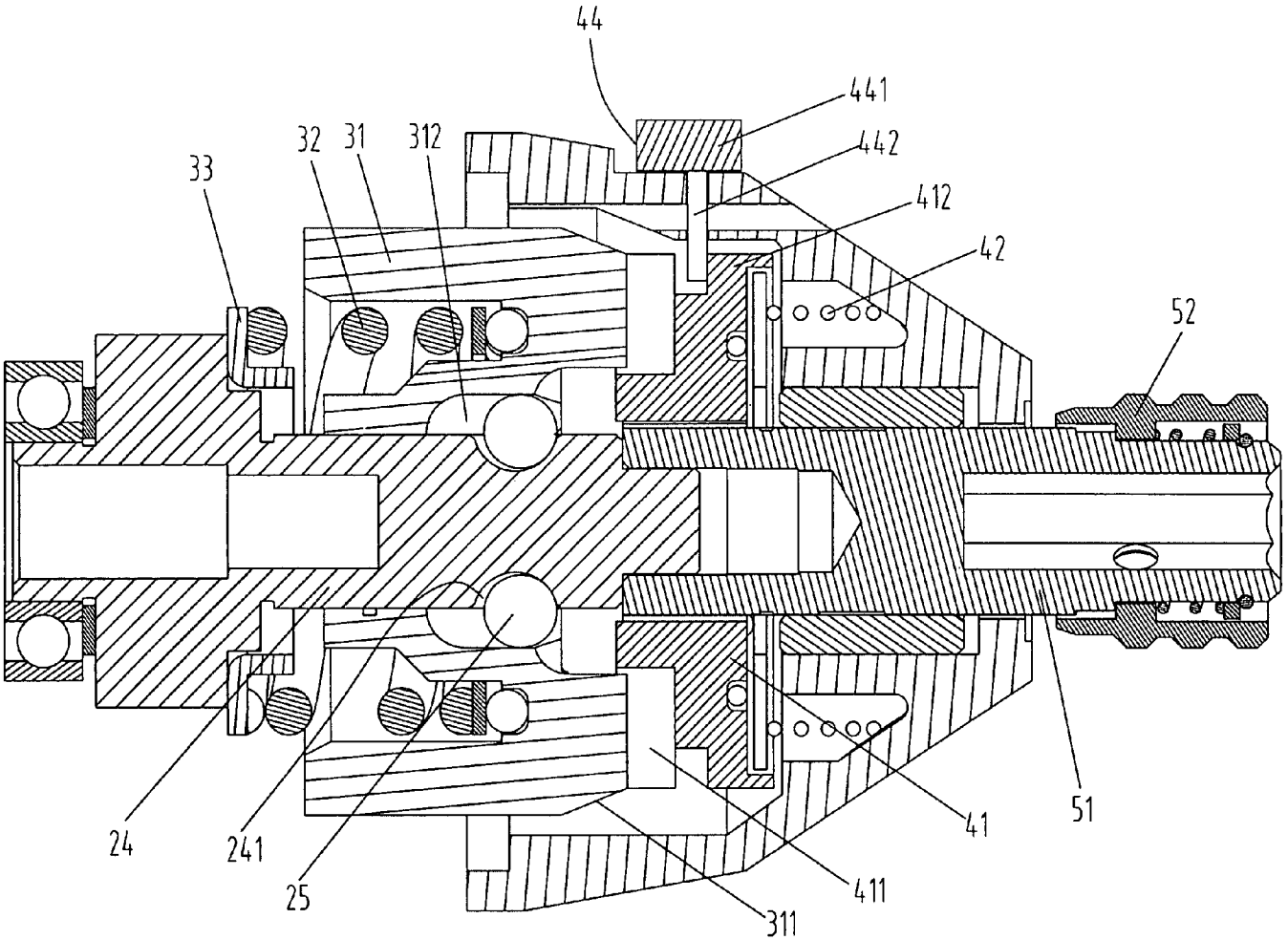
FIG. 4 shows the power tool in high resistant status of the impact wrench function status; at this time, function shifting button is at the first location, the active-active impact block has deviated from the passive-active impact block under the driving of the motor, while the passive-active impact block is incapable of following the active impact block to make axial movement due to the limitation of function shifting button, thus to realize impact function.
Figure 5:
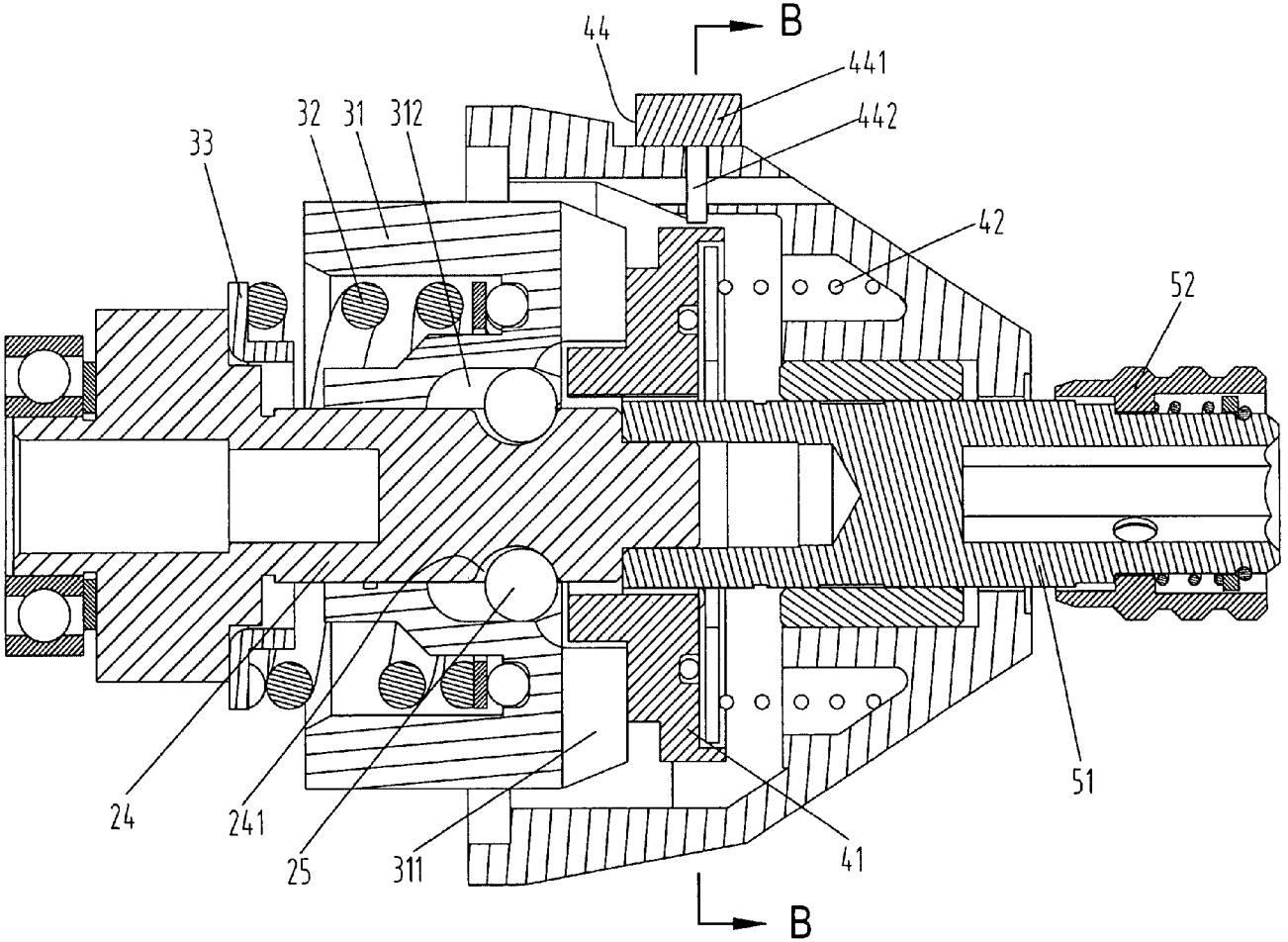
FIG. 5 is similar to FIG. 3, but the difference lies in that the function shifting button is at the second location, the passive-active impact block can move together with the active-active impact block, this power tool then realizes drilling function accordingly.

FIG. 3 and FIG. 4 disclose the working situation when the power tool realizes impact wrench function, wherein FIG. 3 shows the low resisting moment status when the tool is in the impact wrench function status, FIG. 4 shows the high resisting moment status when the tool is in the impact wrench function status. When realizing the impact wrench function, the function shifting button 44 is adjusted to the first location as shown in FIG. 6, at this time, the function shifting button 44 and the passive impact block fit each other, namely, the location limiting part 442 is located in the spacing area 413 of the passive impact block. The passive impact block 41 is apt to make movement toward the active impact block 31 under the compression of the compression piece 42. However, the pressure from the impact spring 32 makes the first end tooth 311 of the active impact block 31 and the second end tooth 411 of the passive impact block mesh with each other, so as to limit and stop the movement of the passive impact block 41. When the power tool runs, the main shaft 24 is driven by the rotation of the motor output shaft 12. Through the driving of the ball 25 included in inner and outer spiral scrolls 312, 241, the active impact block 31 follows to rotate, then the passive impact block 41 rotates as well, and then tightens the nuts (no shown in the drawings) rapidly through the working shaft 51 and tool gripper 52 to drive the working head (now shown in the drawings).

When the nut end face contacts the surface of the working piece (not shown in the drawings), the resisting moment rapidly increases. After reaching a certain value, the active impact block 31 and passive impact block 41 engaged with each other are both held back. The passive impact block 41 stops rotation, but the main shaft 24 keeps rotation under the driving of the motor output shaft 12, in this way, to force the ball 25 to roll along the scroll by overcoming the friction force between the inner and outer spiral scrolls 312, 241, so as to push the active impact block 31 to move toward the motor and compress the impact spring 32. In this process, the early-stage passive impact block 41 makes axial movement at a tiny distance along with the active impact block 31 under the action of the compression piece 42. However, when the location limiting part 442 of the function shifting button 44 is propped up, further movement is impossible. Therefore, the active impact block 31 is gradually away from the passive impact block 41 in the axial direction. When the axial movement distance of the active impact block 31 exceeds the height of the second end tooth 411 of the passive impact block, namely, at the moment the active impact block 31 and passive impact block 41 ungear each other, the main shaft 24 drives the active impact block 31 to rotate so that the first end tooth 311 slides over the second end tooth 411 of the passive impact block. At the moment of sliding, due to the impact spring 32, the ball 25 returns to the original location along the spiral scrolls 312, 241 again. The active impact block 31 is pushed forwards, and impacts the second end tooth 411 of the passive impact block due to the accelerated rotation of the main shaft 24 so that the passive impact block 41 keeps movement in the rotation direction. In such cycles, the screw piece can be secured under the force of impact. It is easy to figure out the solution for common technicians in this field and the outer ball spiral scroll impact structure can be also adopted to realize the function of impact wrench. The working process and principles are the same to the inner ball spiral scroll impact structure disclosed in this embodiment, so they are not detailed herein.

When realizing the abovementioned impact wrench function, it is required that the active impact block 31 rotates intermittently to impact the passive impact block 41 so as to enable the working head (fastener) capable of tightening the nuts. However, when realizing the drilling function, it is only required that the working head (twist drill) keeps drilling, while the intermittent impact of the active impact block is not required any more. By referring to FIGS. 5 and 7, when the function shifting button 44 is adjusted to the second location as shown in FIG. 7, namely, the location limiting part 442 is located outside the spacing area 413 of the passive impact block 41. At this time, the power tool is in the working status of drilling function. During drilling, since the resisting moment of the working shaft 51 gradually increases, the active impact block 31 moves toward the motor. At this time, due to the lack of the limitation of the function shifting button 44, the passive impact block 41 makes axial movement along with the active impact block 31 under the compression of the compression piece 42 with respect to the working shaft 51. Meanwhile, active impact block 31, passive impact block 41 and working shaft 51 moves together in the rotation direction. Since the passive impact block 41 and active impact block 31 cannot ungear each other, namely the two blocks cannot form an impact, continuous drilling of the working head can be ensured.

In other embodiments, when the function shifting button is at the second location, namely the passive impact block moves together with the active impact block, the clutch structure added between the planetary gear reduction system of the power tool and inner ball spiral scroll impact structure can realize the electric screwdriver set function correspondingly, while the active impact block structure of dynamic, static end teeth in the front of the working shaft can realize impact drill function correspondingly. The abovementioned functions can be set separately and form double-functional power tool in combination with the impact wrench function, form tri-functional power tool or quarter-functional power tool by means of overlying setting. Since the abovementioned functional mechanism added is the existing technology and it has been described in detail in the reference document cited by the background technology of this application, it is unnecessary for the applicant to give details herein.

The invention claimed is:

1. A multi-functional power tool comprising:

a housing, a motor set in the housing, a main shaft driven through the rotation of the motor, a working shaft for connecting a working head when running, an active impact block, which can make axial motion with respect to the main shaft, is configured on the main shaft, a passive impact block which rotates with the working shaft and can alternatively make axial motion with respect to the working shaft is mounted on the working shaft, wherein the active impact block rotates to drive the passive impact block through the coordination of a first end tooth set on the active impact block and a second end tooth set on the passive impact block, and wherein the power tool further includes a function shifting button which can move between a first location and a second location to alternatively limit the axial motion of the passive impact block with respect to the working shaft to realize the shifting between a first function and a second function of the power tool.

2. The multi-functional power tool according to claim 1, further comprising a compression piece set on the passive impact block and away from the side of the active impact block, wherein the compression piece compresses the passive impact block so that the passive impact block is apt to make movement toward the active impact block.

3. The multi-functional power tool according to claim 2, wherein the compression piece is a spiral spring.

4. The multi-functional power tool according to claim 2, when the function shifting button is at the first location, the button and the passive impact button fit to limit the axial motion of the passive impact block, the power tool realizes the first function at this time; when the function shifting button is at the second location, the function shifting button and passive impact block are unfitted, and the passive impact block can make axial motion with the active impact block under the compression of the compression piece, the power tool realizes the second function at this time.

5. The multi-functional power tool according to claim 1, wherein the passive impact block is provided with a shoulder on the side toward the active impact block, the shoulder and the second end tooth are set at certain spacing, wherein the function shifting button is equipped with the location limiting part in the housing; when the function shifting button is at the first location, the location limiting part is in the spacing area between the shoulder of the passive impact block and the second end tooth, and can be against the shoulder, and when the function shifting button is at the second location, the location limiting part is outside the spacing area.

6. The multi-functional power tool according to claim 1, wherein at least one of the working shaft and the passive impact block is provided with a raised key extended along the axial direction at the fit location of the two parts, and wherein the other one is provided with a key slot fit for the raised key which can slide in the key slot.

7. The multi-functional power tool according to claim 1, wherein the function shifting button is included in the outer operating portion of the housing and the spacing portion of the housing, and wherein operating portion and restriction portion pass through to move hinge fitting, restriction portion and housing pass through the fixed pivot and connect.

8. The multi-functional power tool according to claim 1, wherein the power tool further includes an impact mechanism which realizes the impact wrench function through the active impact block to exert intermittent impact on the passive impact block in rotation direction, wherein the first function is impact wrench function.

9. The multi-functional power tool according to claim 8, wherein the second function is further defined as at least one of a drilling function and an electric screwdriver set and an impact drill function.

10. The multi-functional power tool according to claim 1, further comprising an impact spring disposed elastically against the active impact block and away from the side of the passive impact block, and a ball at the junction of the active impact block and main shaft, wherein spiral scrolls for housing the ball and allowing the rolling of the ball inside are located on the inner wall of the active impact block and main shaft.

11. The multi-functional power tool according to claim 1, further comprising a planetary gear reduction system connected between the motor and the main shaft for reducing the motor output rotation speed.

12. A drilling tool comprising:

a housing, a power source, a main shaft driven by the power source and a working shaft fit for the working head, the main shaft is provided with impact storage block making axial movement with respect to the main shaft, wherein the working shaft is provided with the passive impact block in axial movement, a first working mode and a second working mode existing between the impact storage block and passive impact block, wherein there is no relative axial displacement between the impact storage block and passive impact block in the first working mode, while there is relative axial displacement between the impact storage block and passive impact block in the first working mode, and a function shifting button is set on the housing, which includes a location limiting part alternatively limiting the axial movement of the passive impact block.

13. An impact tool, comprising:

a motor, housed in an housing;

a main shaft, driven by the rotation of the motor;

a working shaft, set in the housing, extending forward to drive a working head to work on working piece;

an active impact block, set on the main shaft and driven by it;

a passive impact block, set on the working shaft and capable of making axial motion with respect to the working shaft, wherein the active impact block fits or deviates from the passive impact block according to the load on the working shaft so as to exert intermittent impact on the impact block in the direction of rotation; and an operation piece, set on the housing and capable of moving between the first location and the second location;

when the operation piece is at the first location, the passive impact block can deviate from the active impact block due to the limitation of the operation piece so as to form the said impact, thus realizing an impact mode;

when the operation piece is at the second location, the passive impact block can move together with the active impact block so as not to form an impact between them, thus realizing the drilling mode.

14. A power tool, comprising:

a housing;

a power source, set in the housing and outputting rotational power;

a working shaft, extending toward the front of the housing and capable of connecting the external working head;

a gear reduction mechanism, set between the power source and working shaft and transmitting the rotational output of the power source to the working shaft;

an active impact block, driven by the rotation of output shaft of the gear reduction mechanism;

a passive impact block, capable of engaging with the active impact block and driven by the rotation, the passive impact block is set on the working shaft and rotates to drive the working shaft, and the passive impact block can make axial motion with respect to the working shaft, wherein the active impact block can alternatively ungear the passive impact block when the load on the working shaft increases to the specific value, then mesh with the passive impact block again under the output shaft's rotation driving, thus to exert intermittent impact on the working shaft in the direction of rotation; and an impact shifting piece, capable of alternatively limiting the passive impact block's axial motion with respect to the working shaft, so as to make the impact mechanism shift between the impact status that the active and passive impact blocks can ungear each other and the limiting status that the active and passive impact blocks cannot ungear each other.

15. The power tool according to claim 14, wherein the impact shifting piece can move at the first location and the second location alternatively; when the impact shifting piece is at the first location, the impact shifting piece and the passive impact block fit to limit the passive impact block's axial movement with respect to the working shaft so as to realize impact status; when the impact shifting piece moves to the second location, the impact shifting piece and passive impact block are unfitted, and the passive impact block can move toward the back of the housing along the axial direction together with the active impact block so as to realize impact limiting status.

16. The power tool according to claim 15, wherein the first location and the second location are distributed in radial direction perpendicular to the axial direction of the working shaft.

17. The power tool according to claim 14, further comprising a compression piece set on the passive impact block and away from the side of the active impact block, wherein the compression piece compresses the passive impact block so that the passive impact block is apt to make movement toward the active impact block.

18. The power tool according to claim 17, wherein the compression piece is a spiral spring.

19. The power tool according to claim 14, further comprising an impact spring elastically against the active impact block and away from the side of the passive impact block, and a ball at the junction of the active impact block and main shaft, wherein spiral scrolls for housing the ball and allowing the rolling of the ball inside are located on the inner wall of the active impact block and main shaft; when the load on the working shaft increases to the specific value, the active impact block can move toward the back of the housing relative to the main shaft along with the rolling of the spiral scrolls.

20. The power tool according to claim 14, wherein the power source is an engine.

* * * * *